US011186982B2

(12) United States Patent
Lubinski

(10) Patent No.: US 11,186,982 B2
(45) Date of Patent: Nov. 30, 2021

(54) MODULAR SUPPORT FRAME

(71) Applicant: Ron Lubinski, Caledon (CA)

(72) Inventor: Ron Lubinski, Caledon (CA)

( * ) Notice: Subject to any disclaimer, the term of this patent is extended or adjusted under 35 U.S.C. 154(b) by 0 days.

(21) Appl. No.: 15/305,472

(22) PCT Filed: Apr. 23, 2015

(86) PCT No.: PCT/CA2015/000386
§ 371 (c)(1),
(2) Date: Oct. 20, 2016

(87) PCT Pub. No.: WO2015/161364
PCT Pub. Date: Oct. 29, 2015

(65) Prior Publication Data

US 2018/0010327 A1 Jan. 11, 2018

Related U.S. Application Data

(60) Provisional application No. 61/983,026, filed on Apr. 23, 2014.

(51) Int. Cl.
*E04B 1/343* (2006.01)
*E04B 1/24* (2006.01)
(Continued)

(52) U.S. Cl.
CPC ..... *E04B 1/34352* (2013.01); *E02D 27/01* (2013.01); *E02D 27/013* (2013.01);
(Continued)

(58) Field of Classification Search
CPC .. E04B 1/34352; E04B 1/2403; E04B 1/1903; E04B 2001/1993;
(Continued)

(56) References Cited

U.S. PATENT DOCUMENTS 1,982,343 A * 11/1934 Kane ..... E04B 1/30 52/252
3,300,931 A * 1/1967 Lutze ..... E04B 7/00 264/263
(Continued)

*Primary Examiner* — Brent W Herring
(74) *Attorney, Agent, or Firm* — Johnson & Martin, P.A.; James David Johnson

(57) ABSTRACT

A modular support frame comprises trusses, purlins transverse to the trusses, and vertical posts supporting the various trusses. A supply of wedges permits flange-type connectors to be joined to complementary connectors throughout the foundation. The trusses are arranged end-to-end in parallel rows, each row comprising at least one pair of trusses or more depending on the desired size of the foundation. Vertical posts are positioned between the ends of each of the trusses within a row and at opposing ends of the row, and each post comprises a pair of flange-type connectors at predetermined heights. Each of the trusses is terminated at either end with a pair of complementary connectors such that adjacent in-line trusses can be mounted to the post between them and the outer pair of trusses can be mounted to the posts terminated the row. Purlins extend perpendicularly between the trusses in adjacent rows to reinforce the frame. To that end, the trusses comprise flange-type connectors and the purlins are terminated at either end with complementary connectors.

3 Claims, 4 Drawing Sheets

(51) Int. Cl.

| | |
|---|---|
| ***E02D 27/01*** | (2006.01) |
| ***E04B 1/19*** | (2006.01) |
| *E04B 1/00* | (2006.01) |
| *E04H 3/24* | (2006.01) |

(52) U.S. Cl.
CPC ..... *E02D 27/016* (2013.01); *E04B 1/1903* (2013.01); *E04B 1/2403* (2013.01); *E04B 1/0007* (2013.01); *E04B 2001/199* (2013.01); *E04B 2001/1993* (2013.01); *E04B 2001/2424* (2013.01); *E04B 2001/2457* (2013.01); *E04B 2001/2466* (2013.01); *E04B 2103/06* (2013.01); *E04H 3/24* (2013.01)

(58) Field of Classification Search
CPC ..... E04B 2001/2466; E04B 2001/2424; E04B 2001/2457; E04B 2001/199; E04B 2103/06
USPC ..... 52/633, 648.1, 650.1, 650.3, 634, 690, 52/691, 692, 263
See application file for complete search history.

(56) References Cited

U.S. PATENT DOCUMENTS 4,425,742 A * 1/1984 Markey ..... E04B 1/2612 52/262
4,432,178 A * 2/1984 Taft ..... E04B 5/40 52/334
4,445,307 A * 5/1984 Puccinelli ..... E04G 7/307 182/186.7
4,512,117 A * 4/1985 Lange ..... E04H 3/10 403/331
4,586,300 A * 5/1986 Mullin ..... E04B 1/24 403/189
4,863,126 A * 9/1989 Rogers ..... A63J 1/02 248/158
4,863,189 A * 9/1989 Lindsay ..... B60P 3/32 280/789
5,078,532 A * 1/1992 Williams ..... E04G 7/308 182/186.8
5,205,101 A * 4/1993 Swan ..... E04B 1/34331 411/344
5,771,655 A * 6/1998 Strickland ..... E04B 5/10 52/650.3
7,698,860 B2 * 4/2010 Hockemeyer ..... E04F 15/02044 182/179.1
8,793,948 B2 * 8/2014 Beattie ..... E04B 1/26 52/267
8,966,855 B1 * 3/2015 Miller ..... E04B 5/14 52/650.3
9,249,574 B2 * 2/2016 Mei ..... E04C 3/18
2008/0053003 A1 * 3/2008 Hockemeyer ..... E04B 1/34315 52/22
2008/0053017 A1 * 3/2008 Hockemeyer ..... E04B 7/022 52/263
2008/0053018 A1 * 3/2008 Hockemeyer ..... E04H 1/1205 52/263
2008/0053032 A1 * 3/2008 Hockemeyer ..... E04B 7/024 52/651.07
2009/0217495 A1 * 9/2009 Tipps ..... E04F 15/02 24/458
2012/0079776 A1 * 4/2012 Beattie ..... E04B 1/26 52/90.1
2013/0104493 A1 * 5/2013 Orchard ..... E04F 15/02044 52/704
2015/0040504 A1 * 2/2015 Mei ..... E04B 1/26 52/309.13
2016/0009213 A1 * 1/2016 Doucet ..... E04H 3/28 52/7
2017/0298622 A1 * 10/2017 McManus ..... E04B 5/023

* cited by examiner

MODULAR SUPPORT FRAME

FIELD OF THE INVENTION

The invention relates to modular support frames that can be used to form foundations for housing, to form a platform or the like.

DESCRIPTION OF PRIOR ART

It is common in cold northern regions to erect a modular foundation to support modular housing. The foundation may be assembled with myriad structures each comprising a lower junction and a multiplicity of tubular struts that radiate upward and outward in various directions from the junction. There are significant shortcomings to this arrangement. A crane may be required to position such structures in adjacent relationship, and nut and bolt fasteners may be required to join adjacent. A T-brace may be required to provide additional support to overhead beams. Lastly, considerable labour is required to assemble the foundation. Other support frames pose similar problems.

SUMMARY OF THE INVENTION

The invention provides a modular support frame that is assembled with particular connectors. The configuration of such connectors is apparent in U.S. Pat. No. 5,411,113 to the present invention. The connectors have become common in the assembly of scaffolds, but not foundations and comparable supporting frames. Each joint comprises a horizontal flange connected as by welding to one component to be joined. The flange has multiple circumferentially spaced openings. A complementary connector is welded to the other component to be joined. The complementary connector comprises upper and lower sections that define a horizontal mouth for receiving the flange, and comprises openings in the upper and lower sections of the complementary connector that allow a wedge to be received and extended through one of the openings in the flange, thereby securing the joint.

In one aspect, the invention provides a support frame comprising trusses, vertical posts supporting the trusses, and purlins mounted between the trusses. The trusses are arranged end-to-end in a multiplicity of parallel rows, each row comprising at least one pair of trusses or more depending on the desired size of the support frame in the general direction of the trusses. The number of parallel rows of trusses sets the size of the support frame in a direction transverse to the trusses. This arrangement allows a support frame of desired size to be assembled using sets of identical trusses, purlins and posts.

Each truss has a pair of connectors at either end that is complementary to flange-type connectors associated with the posts. The complementary connectors are positioned at heights corresponding to the heights of the flange-type connectors associated with the posts. A post, which may typically have a base capable of seating on a generally horizontal surface, is positioned between each pair of trusses within a given row. Each row of trusses is terminated at either end with a post, and the trusses adjacent to these outer posts may be connected to the posts using the flange-type connectors associated with the posts and the complementary connectors at outer ends of the trusses. A similar arrangement of trusses and posts, transverse to the rows, may be used to join and terminate the ends of the various rows of trusses.

The purlins serve to reinforce the support frame defined by the rows of trusses. Each purlin extends perpendicular to and joins a pair of parallel trusses located in adjacent rows. To that end, each truss may comprise one or more flange-type connectors. Each purlin has a pair of opposing ends terminated with complementary connectors so that the purlin may be fastened to the flange-type connectors associated with the adjacent parallel trusses. In modular housing, it may be sufficient to extend a single purlin between adjacent parallel pairs of trusses. In modular platforms, multiple purlins may extend between adjacent parallel pair of trusses to provide better support for wooden floor panels laid atop the support frame, and each truss may carry multiple flange-type connectors, spaced to accommodate the multiple purlins. In preferred form, the trusses preferably comprise three horizontal cords, one lowermost, one uppermost and one intermediate but proximate to the top chord. An upright extends between the chords, and the truss's flange-like connector may be welded to the upright in a horizontal orientation between the upper and intermediate chords. In preferred form, in a platform, each of the purlins may comprise a lengthwise groove in its upper surface in which is located a material (typically wood or plastic) that can be penetrated by a nail and hammering. The panels associated with the platform can be nailed into place.

The support frame is preferably constructed of aluminum to reduce overall weight. The advantage of the support frame is that two workers can assemble the support fame in a matter of hours, which has not been possible in the prior art.

DESCRIPTION OF THE DRAWINGS

The invention will be better understood with reference to drawings illustrating embodiments of the invention, in which.

DESCRIPTION OF PREFERRED EMBODIMENTS

Figure 1:
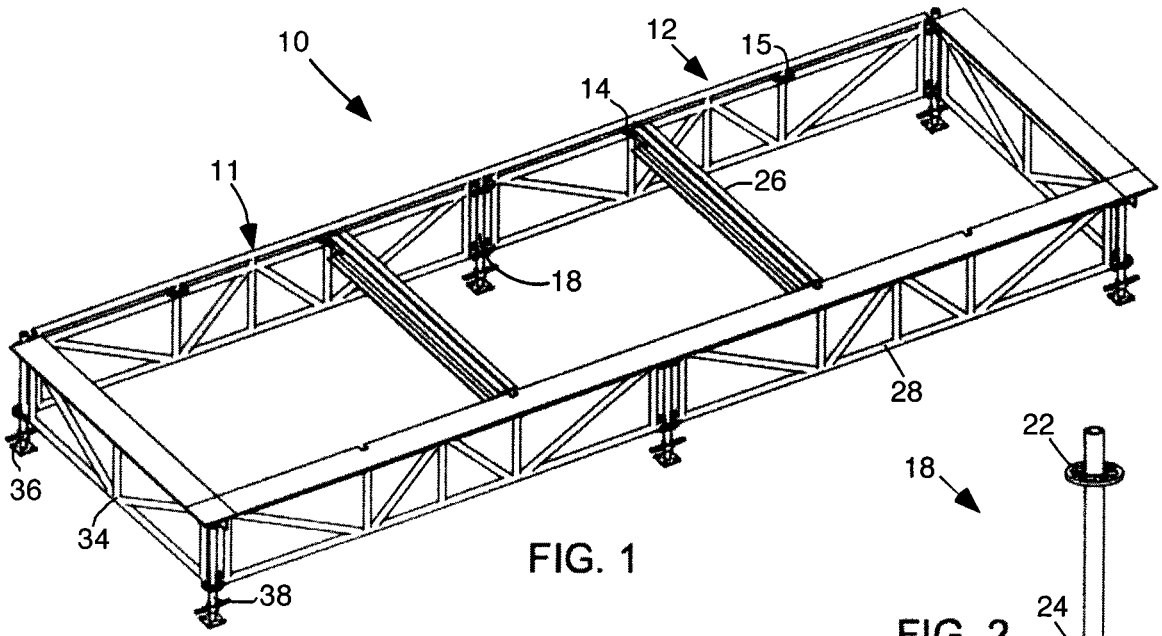
FIG. 1 is a perspective view of a modular support frame.
Figure 3:
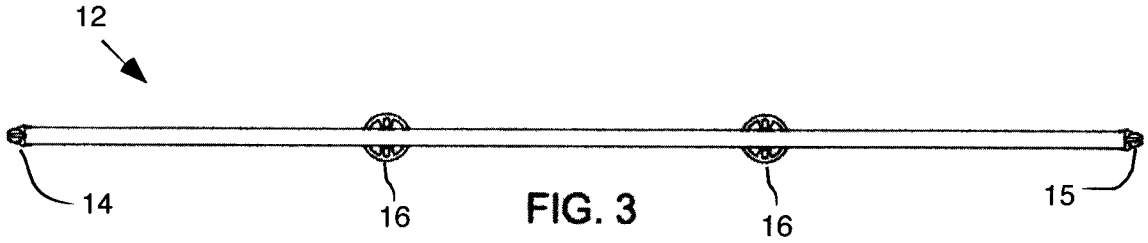
FIGS. 3 and 4 are a plan view and a side elevation respectively of a truss used in the support frame.
Figure 4:
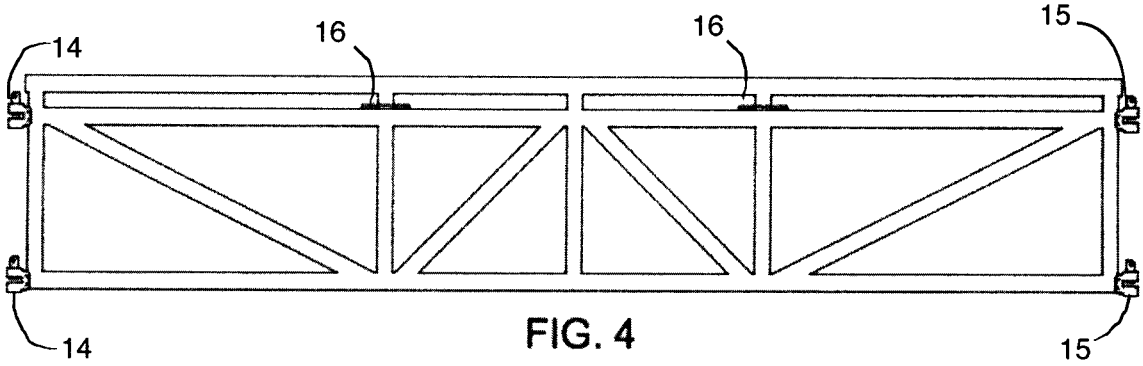

Reference is made to FIG. 1, which illustrates an assembled modular foundation 10 suitable for supporting modular housing. The foundation 10 comprises a multiplicity of trusses arranged in two rows, each row comprising a pair of trusses arranged in-line, such as the exemplary trusses 11, 12. The construction of the exemplary truss 12 is more apparent in FIGS. 3 and 4. What should be noted is that the truss 12 is terminated at either end with a pair of connectors 14 or 15 complementary to flange-type connectors. Also, the truss 12 carries a pair of flange-type connectors 16 adjacent its top for mounting purlins.

Figure 2:
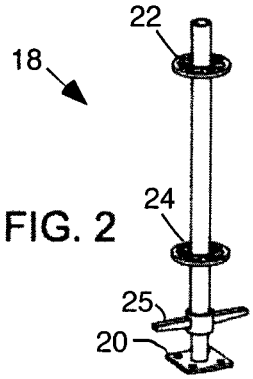
FIG. 2 is a perspective view of a post used to support trusses in the support frame.

The foundation 10 also comprises a multiplicity of posts. A typical post 18 is detailed in FIG. 2 where it may be seen to comprise a base plate 20 for standing on a horizontal surface, a pair of vertically spaced-apart flange-type connectors 22, 24 and a height-adjustment mechanism 25. One post is positioned between the trusses in each of the rows, such as the post 18 located between the trusses 11, 12. Both trusses 11, 12 are fastened to the post 18 by securing the pair of complementary connectors terminating ends of the trusses 11, 12 adjacent to the post 18 to the flange-type connectors of the post 18. Each row is terminated at either end with a post, and ends of the trusses proximate to the post are fastened to the post by mating the flange-type connector associated with the posts to the complementary connectors at the proximate end of the truss.

Figure 5:
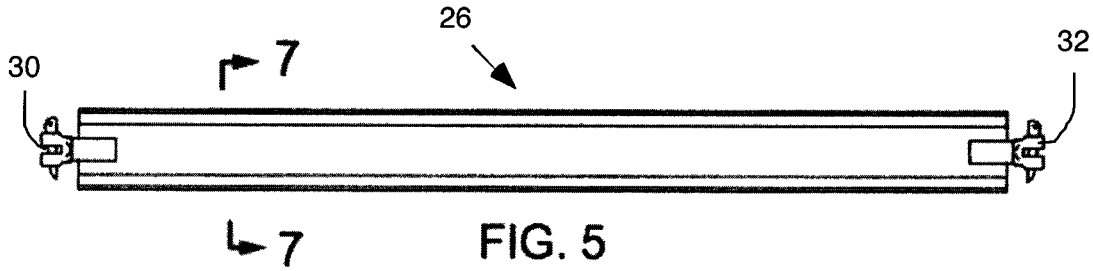
FIGS. 5 and 6 are respectively a side elevation and a plan view of a purlin used in the support frame.
Figure 6:
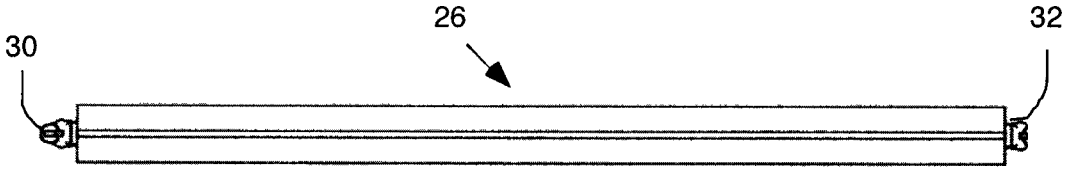
Figure 7:
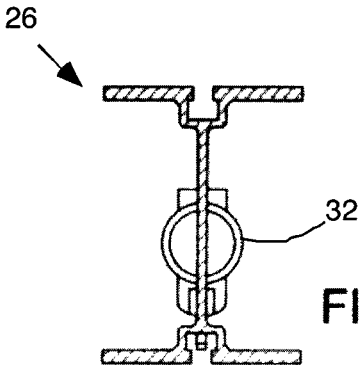
FIG. 7 is a cross-section along lines 7-7 of FIG. 5.

The foundation also comprises a multiplicity of purlins that extend perpendicular to the rows of trusses and serve to join adjacent parallel trusses to one another to stabilize the rows. A typical purlin 26 is shown in FIG. 1 joining the trusses 12, 28. The purlin 26 is shown in greater detail in FIGS. 5, 6 and 7. It should be noted that the purlin 26 is terminated at either end with a connector 30, 32 complementary to the flange-like connectors carried atop the trusses. In this instance, the connector 30 of the purlin 26 is fastened to the flange-type connector 18 of the truss 12. The opposing connector 32 of the purlin 26 is similarly fastened to the truss 28. In this implementation of the invention, only a single purlin extends between trusses in adjacent rows, fastening to the flange-type connectors of the trusses. However, if required, each truss may be topped with multiple flange-type connectors and multiple beams terminated with complementary connectors may be used to join adjacent trusses.

The rows of trusses are terminated at opposing ends with additional trusses perpendicular to the rows, such as the exemplary truss 34 apparent in FIG. 1. The truss 34 is terminated at either end with a pair of connectors (not shown) complementary to the flange-type connectors associated with the posts. The truss 34 is thus mounted to the posts 36, 38 terminating the rows of trusses. Plates are mounted to the various trusses to provide stable mounting surface for various parts of the house frame to be mounted on the foundation 10.

Figure 8:
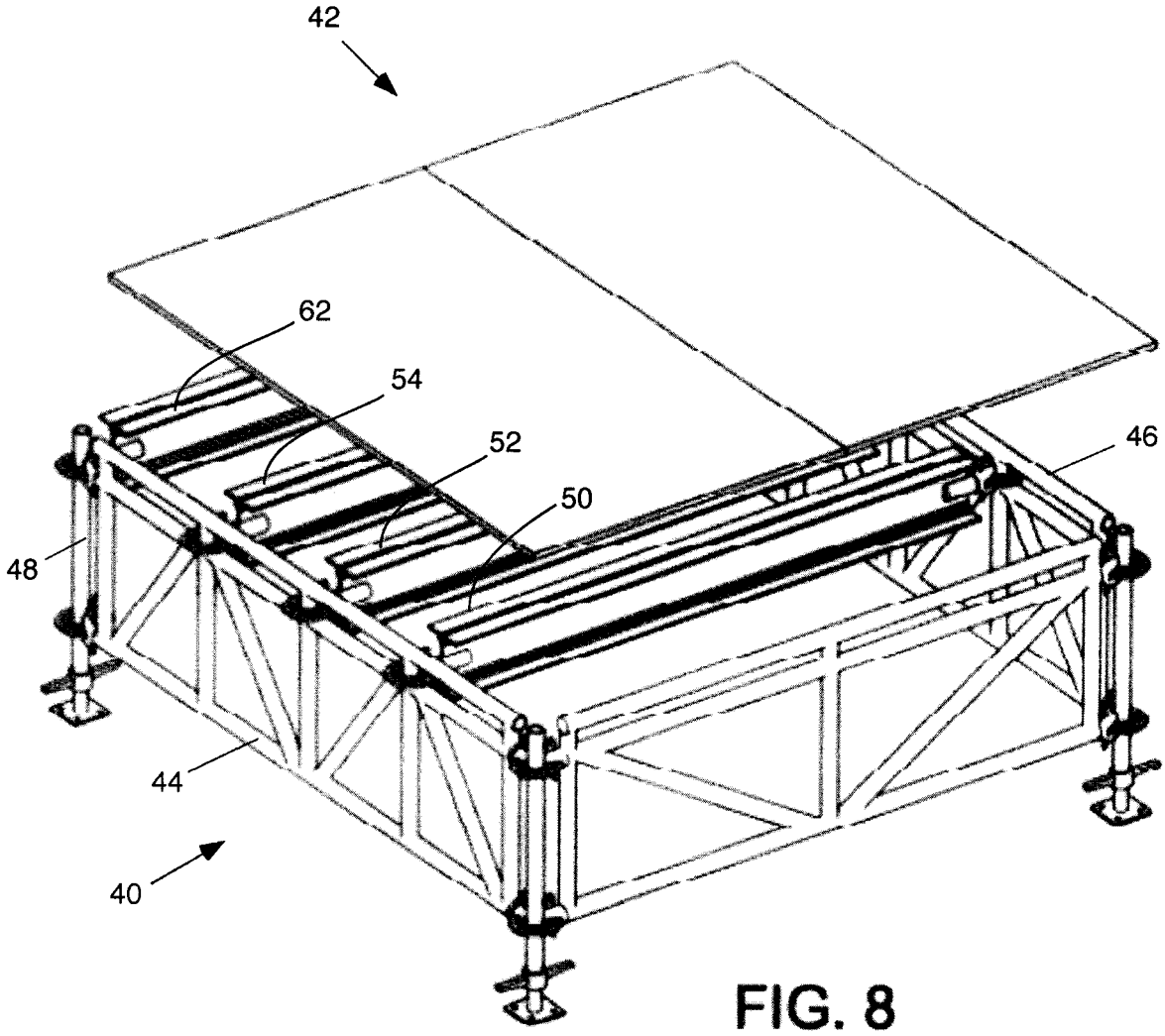
FIG. 8 is a partially exploded perspective view of a modular support frame adapted to support a stage of floor panels.

FIG. 8 shows another modular support frame 40, this one adapted to support wooden floor panels 42 to form a stage. To enhance detail in the drawings, only a single cell within the support frame 40 and two floor panels 42 has been illustrated. Like the support frame 10 of FIG. 1, there are trusses 44, 46 in parallel rows, posts such as the post 48 that support in-line adjacent trusses (not shown in FIG. 8), and purlins 50, 52, 54 extending between the trusses 44, 46. In practice further in-line trusses, posts and purlins would typically extend rearward from the post 48.

Exemplary truss 44, comprises three cords like the trusses in FIG. 1. However, the truss 44 comprises a total of three horizontally spaced-apart flange-type connectors 58 located on internal posts proximate to the top of the truss 44. It will be noted that multiple purlins 50, 52, 54 extend between the pair of adjacent parallel trusses 44, 46 to stabilize the structure and to support the wood panels 42.

Figure 9:
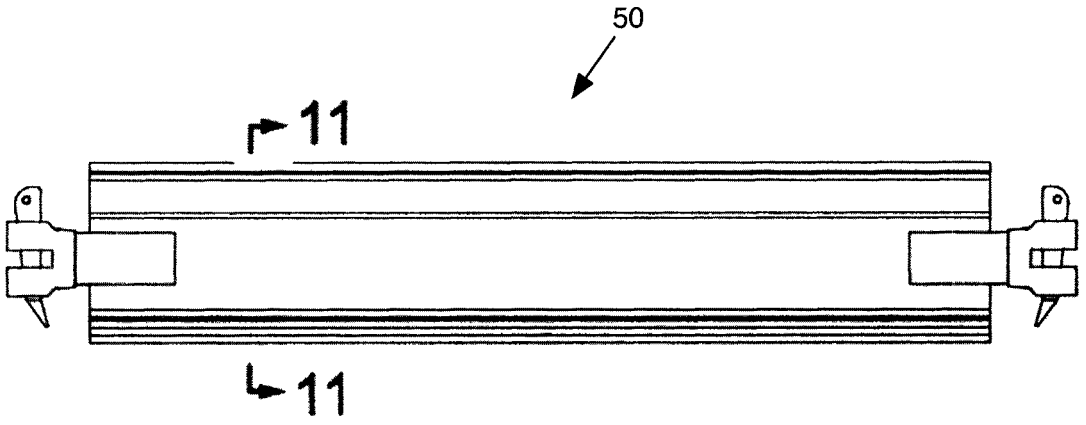
FIGS. 9 and 10 are respectively a side elevation and plan view of a purlin used in the support frame of FIG. 8; and, FIG. 11 is a cross-section view along line 11-11 of FIG. 9.
Figure 10:
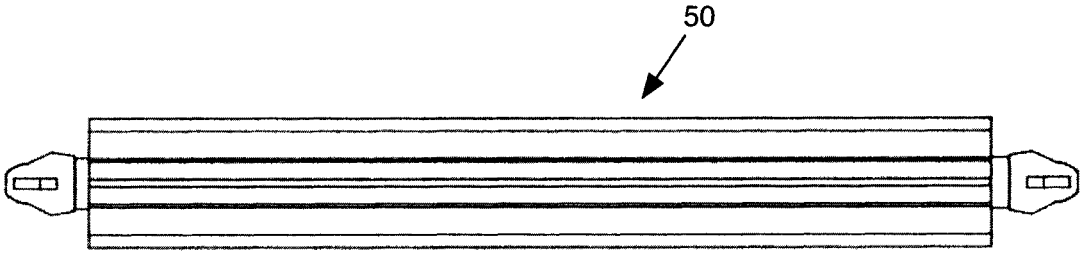
Figure 11:
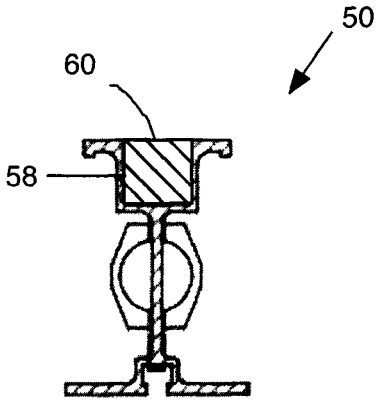

The purlin 50, which is typical, is shown in greater detail in FIGS. 9-11. The purlin 50 comprises a connector at either end, which is complementary to the flange-type connectors associated with the trusses 44, 46. The purlin 50 comprises a lengthwise channel 58 (indicated in FIG. 10) in an upper surface of the purlin 50 that contains a lengthwise wood insert 60 (indicated in FIG. 10) fastened to the purlin 50. This allows floor panels 42 to be nailed easily in place on the purlins 50, 52, and 54. The upper surface may be provided by using a substantially I-beam construction to define both the upper and lower surfaces of the purlins 50-54. It should be noted that central trusses extending between the adjacent rows of trusses in FIG. 1 have been eliminated. Instead purlins, such as the purlin 62 in FIG. 8 are fastened between posts in the adjacent rows of trusses.

Other aspects of the invention will be apparent from the drawings and this disclosure, and may fall within the ambit of the claims.

I claim:

1. A modular support frame comprising:

a plurality of trusses arranged in parallel rows, each of the rows comprising at least one pair of trusses, each of the trusses in each row comprising a vertical general plane aligned with the vertical general plane of each other truss in each row, each of the trusses comprising a pair of vertically spaced-apart connectors located at each end of the truss and adapted to mate with a circular flange-type connector, each of the trusses comprising a horizontally oriented flange-type connector;

a plurality of posts, each of the posts comprising an upper and a lower flange-type connector for connection to a corresponding flange-type connector of one of the trusses, each of the trusses being associated with a pair of the posts with one post located at each end of the associated truss and being mounted to the associated posts using the flange-type connectors at either end of the truss;

a plurality of purlins oriented perpendicular to the trusses, each of the purlins comprising a connector fastened to the flange-type connector of one of a pair of trusses in adjacent rows, each of the purlins comprising a connector fastened to the flange-type connector of the other of the pair of parallel trusses; and wherein flange-type connectors and complementary connectors are joined throughout the support frame;

wherein each of the purlins comprises a lengthwise groove in its upper surface and an elongate insert within the groove;

wherein each of the inserts is formed of a material capable of receiving a nail by hammering;

wherein a multiplicity of wooden panels is mounted on the upper surfaces of the purlins to define a flat deck; and wherein each of the wood panels is nailed to one or more of the inserts associated with the purlins.

2. The modular support frame of claim 1, wherein:

each of the trusses comprises three horizontal chords including a lowermost chord, an uppermost chord, an intermediate cord between the uppermost and lowermost cords, an upright extending between the intermediate and uppermost; and the flange-type connector associated with each truss is fastened to the upright of the truss between the intermediate and uppermost chords of the truss.

3. The modular support frame of claim 1, wherein the flange-type connectors and complementary connectors are joined throughout the support frame by wedges.

* * * * *